United States Patent [19]

Delahousse et al.

[11] 3,938,224

[45] Feb. 17, 1976

[54] DEVICES FOR USE IN THE MANUFACTURE OF ARTICLES OF UPHOLSTERY

[75] Inventors: Regis J. Delahousse, Moze-sur-Louet; Philippe J. Delahousse, Brissac-Quince, both of France

[73] Assignee: Etablissements Delahousse et Bruant, Brissac-Quince, France

[22] Filed: Jan. 16, 1974

[21] Appl. No.: 433,798

[30] Foreign Application Priority Data

Jan. 16, 1973 France ..... 73.01478

[52] U.S. Cl. ..... 24/102 T; 5/356

[51] Int. Cl.[2] ..... A44B 1/24

[58] Field of Search ..... 24/102 T, 230.5 TP, 100, 24/100.5, 5; 5/356; 112/224; 223/104

[56] References Cited

UNITED STATES PATENTS

| | | | |
|---|---|---|---|
| 94.384 | 8/1869 | Blanchard | 112/224 |
| 103,549 | 5/1870 | Blanchard | 112/224 |
| 116,087 | 6/1871 | Ostburg | 5/356 X |
| 1,873,607 | 8/1932 | Lefevre | 24/102 T |
| 1,950,613 | 3/1934 | Katt | 24/102 T |
| 2,016,157 | 10/1935 | Rosberger | 5/356 |
| 2,048,292 | 7/1936 | Rau | 24/102 T |
| 2,139,128 | 12/1938 | Martin | 24/102 T |
| 3,581,688 | 6/1971 | Ketterer | 112/224 |

*Primary Examiner*—Werner H. Schroeder
*Assistant Examiner*—Peter Nerbun
*Attorney, Agent, or Firm*—Lewis H. Eslinger

[57] ABSTRACT

A device for use in the manufacture of buttoned upholstery includes a loop of thread or the like and a bar having a notch which is capable of receiving and nipping a part of the thread of the loop. The bar and thread are passed through an eyelet of an ornamental button and a half-hitch knot is formed. The bar is passed through the article and when turned at right angles to the loop forms an anchorage on the surface of the article opposite the surface receiving the button.

8 Claims, 7 Drawing Figures

DEVICES FOR USE IN THE MANUFACTURE OF ARTICLES OF UPHOLSTERY

BACKGROUND OF THE INVENTION

1. Field of the Invention

This invention relates to devices for use in the manufacture of articles of upholstery, for example chairs and mattresses.

2. Description of the Prior Art

Customarily upholstery of cushions or other stuffed articles is effected with the air of pre-formed loops and buttons. In general an ornamental button is covered with material of the main covering of the article and this button has a closed eyelet to which there is attached a preformed loop by a knot termed a "half-hitch". Then, by means of an appropriate machine, after compression of the article, a length of the loop sufficient to reach the other side of the object being upholstered is passed through the article and securing at the opposite side can be effected by means of buttons having open eyelets. The disadvantages of such a method are varied. First of all the attachment of the loop to the ornamental button is a delicate operation, which is time-consuming and costly because the loop is a flexible article and cannot readily be grasped and is difficult to manipulate. Moreover, by this upholstery method, it is necessary to effect manually the buttoning of the other side during a time in which the machine is inoperative which increases the duration of the operations and hence renders them costly.

Another upholstery device has been proposed which consists in using two rods interconnected by a band and which is made to pass by means of appropriate needles, from one of the rods to the other side of the object to be upholstered. The other rod is initially equipped with an ornamental button. The first rod thus situated constitutes the securing button which is positioned automatically. The disadvantages of this device reside in the use of a band connecting the two rods. In fact, the former is of such a thickness that there is risk of damaging the article to be upholstered during the upholstery process. Moreover, the band is constantly urged, because of its tension, to resume its initial size which gives rise to the risk, in time, of notching the opening through which it is passed and this may give rise in time to the detachment of the opposing button.

Finally, the construction of the device including the ribbon and the rods is complicated and costly.

An object of the invention is to overcome all these disadvantages by a simple device which is easy to put into operation.

SUMMARY OF THE INVENTION

According to the present invention, there is provided a device for use in the production of an upholstered article, said device comprising means defining a loop having a length less than the uncompressed thickness of the article to be upholstered, and a bar having means engaging and nipping the loop, said means including a notch extending in a direction normal to the length dimension of the bar, said loop being arranged to be secured to a button which will be incorporated on the operative face of the article.

Preferably, the bar referred to extends from the loop perpendicularly thereto and opposite to the aforementioned knot.

In a first embodiment of the invention, the bar is made of a length of wire having at its middle portion a notch and of which the curved end portions are folded onto the middle portion in such a manner as to lie opposite the notch and to provide means for nipping the aforesaid loop.

In the second embodiment of the invention, the bar is of plastics material and is provided with a V-groove.

In a modification of this embodiment the aforesaid groove comprises along the length of its defining wall at least one lug for retaining the thread.

In a third embodiment, the bar is provided with an inclined slot, opening at one of its ends into a cylindrical aperture which forms a seat for the thread of the loop and has at its other end a chamfer to aid the introduction of the thread into the slot.

Advantageously, one of the buttons of the device, termed the ornamental button, has a closed eyelet and the smallest dimension of the bar is less than the diameter of this eyelet.

Figure 1:
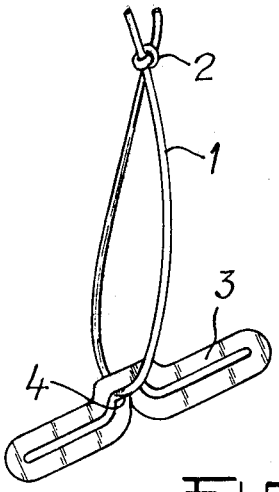
FIG. 1 is a view of the device in accordance with the invention.

Referring first of all to FIG. 1, the device includes a pre-formed loop 1 on which is mounted, opposite a knot 2, a bar 3 provided with a notch 4 for the passage of and for nipping the thread of the loop 1. The loop 1 is generally secured, at the side of the knot 2 to a button termed an "ornamental button" (not shown in FIG. 1).

Figure 2:
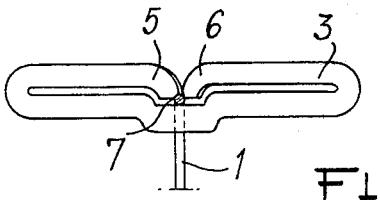
FIG. 2 is a representation of the first embodiment of a bar forming part of the device of FIG. 1.

FIG. 2 shows an embodiment of the bar 3. This is made from a length of wire provided at its centre with a notch 4 and end portions 5 and 6 are curved and are folded inwardly to lie opposite the notch 4. The parts thus form an arrangement for nipping the thread of the loop 1 situated in the notch 4 and indicated by the circle 7.

Figure 3:
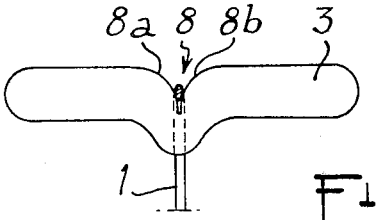
FIG. 3 is a representation of a second embodiment of the bar.

The bar 3 shown in FIG. 3 is made by moulding a plastics material and is provided with a notch 8 of V form of which the walls 8*a* and 8*b* ensure the nipping of the thread of the loop 1 which can be introduced into it by a small force.

Figure 4:
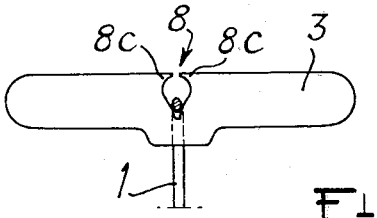
FIGS. 4 and 5 are views of modifications of the embodiment of FIG. 3.

In FIG. 4, the notch 8 of the bar 3 is provided at its opening with retaining lugs 8*c* for the wire which is to be introduced. These lugs, which are flexible, are moulded at the same time as the bar.

Figure 5:
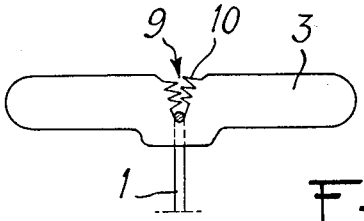

FIG. 5 shows a modification of FIG. 4 having a notch 9 which is provided with a plurality of lugs or teeth such as 10 which ensure the retention of the nipping of the thread of the loop 1.

Figure 6:
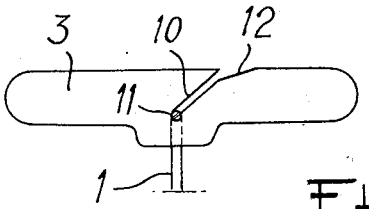
FIG. 6 is a representation of a third embodiment of the bar.

Finally, the bar of FIG. 6 has a slot 10 opening out into a generally cylindrical aperture 11 for receiving the thread of the loop 1. The entry to the slot 10 is offset with respect to the aperture 11 and is provided with a chamfer 12 assisting the introduction of the loop. This off-set arrangement ensures the retention of the loop 1, the nipping of the thread being effected as a result of the diameter of the apertures being slightly smaller than that of the thread.

Figure 7:
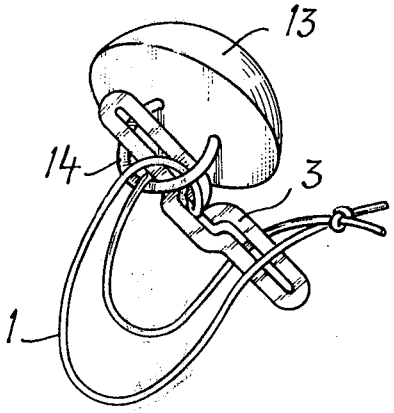
FIG. 7 is a view illustrating the assembly of different parts of a device in accordance with the invention.

FIG. 7 illustrates the connection of a loop 1 provided with its bar 3 and an ornamental button 13 having a closed eyelet 14. The bar 3 is introduced into the eyelet 14, the transverse dimension of the former being less than that of the eyelet, then the bar is passed from the eyelet into the remainder of the loop. By this means a "halfhitch" knot has been produced which secures the loop 1 to the ornamental button 13.

It is to be noted in all the Figures that the base or bottom of the groove accommodates the thread of the loop, situated at the median plane of the bar. The advantage of this location resides in the fact that after mechanically placing the bar in position through an article being upholstered, the bar has a tendency to turn and correctly engage the article, whilst the latter then takes up its initial position and places the loop in tension. The risk of incorrect location of the bar is thus reduced, that is to say the opening of the notch turns against the object being upholstered, and thus the risk of release of the loop.

Figure 8:
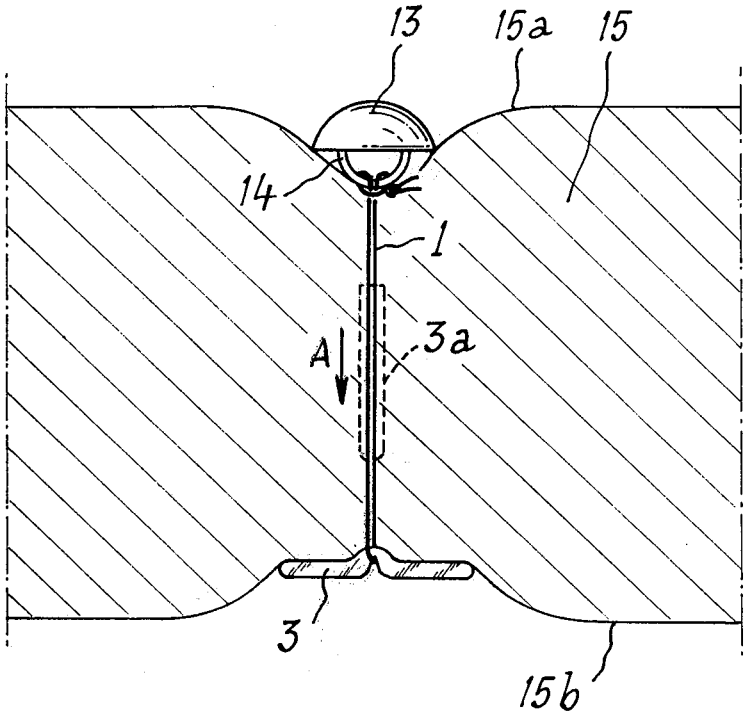
FIG. 8 is an elevational view, in section showing the fastening device of the invention mounted in an upholstered article.

Referring to FIG. 8, it is seen that an upholstering device constructed in accordance with the present invention is inserted in an upholstered article 15 by introducing the bar 3 through the front face 15*a* of the article 15, by means of a needle or other known inserting device, in the direction of the arrow A. The bar 3 is inserted perpendicularly to face 15*a* through article 15, as indicated in dotted lines in the drawing. Once the bar 3 passes out of the rear face 15*b* of article 15, the bar is positioned perpendicularly to loop 1 and parallel to face 15*b* to secure the ornamental button 15 in place and hold the article 15 compressed.

The advantages of such device are several kinds. First of all the positioning of a pre-formed loop in a bar in accordance with the invention is simple and can readily be mechanized. The fact that the bar 3 is secured on the loop 1 enables the construction and indeed the sale of the assembly of loop and bar independently of the ornamental button. Thus, at the assembly stage of the ornamental button with the loop 1 equipped with its bar, the latter plays the roll of a threading means enabling the formation of a half-hitch knot, from which follows an advantageous gain in the upholstering operation.

Such device also enables the use of an upholstery machine known in itself, in which the needles of the latter can facilitate location of the bar for taking it to the opposite side of the stuffed article.

After removal of the needle, the bar is held by the surface of the article and the upholstery button is held in its final place without the necessity for an opposing button. This enables a higher upholstery rate and a shorter immoblisation of the machine for each operation. On the other hand, the thread of the loop being of very small transverse dimensions, cannot damage the stuffing of the article during stitching although it runs externally of the needle. This advantage is preserved, moreover by the presence of the knot of the loop close to the eyelet of the ornamental button, which position is acquired by placing the bar opposite it and by the method of construction of the half-hitch knot. Thus, the thread passes through the article to be upholstered gives rise to no unevenness.

Finally, the two strands of the loop at the region of the bar are separated only by the thickness of the bar and cannot in any event enlarge the perforation through the article thus upholstered during the passage of the needle which is of a dimension larger than this spacing. There is thus no risk of the loss of the bar in the stuffing.

The invention is applicable in the chair and mattress industry.

We claim:

1. A device for use in the production of an upholstered article for securing a button having an eyelet thereon to the face of the article, said device comprising flexible means defining a loop having a length less than the uncompressed thickness of the article to be upholstered, and a thin elongated flat and relatively straight bar adapted to be inserted through the eyelet of the button; said bar including means for engaging and nipping the loop and for maintaining the bar in a relatively fixed position on the loop, said means including a notch extending in a direction normal to the length dimension of the bar, said loop being secured to the eyelet of the button which will be incorporated on the operative face of the article.

2. A device according to claim 1, wherein the bar comprises a length of wire with the notch formed centrally thereof and end portions of the bar bend back over and terminating opposite the notch whereby to form parts of the engaging and nipping means for restricting movement of the loop with respect to the bar.

3. A device according to claim 1, wherein the bar is formed of a moulded plastic material and the notch is of V shape.

4. A device according to claim 3, wherein the means for engaging and nipping the loop includes at least one loop-retaining lug formed on the walls of the V notch.

5. A device according to claim 1, wherein the notch is formed as a slot inclined to the length of the bar having a circular aperture at its inner end and a chamfered outer end to facilitate introduction of the loop, the aperture constituting a location for the loop.

6. A device according to claim 1, wherein the bottom of the notch is disposed on the opposite side of the median plane of the bar to the opening of the notch.

7. A device according to claim 1, wherein the loop is preformed from a length of thread having free ends which are connected by a knot; and said bar extends perpendicularly to the loop and is located along the loop opposite to the knot, whereby the knot is located adjacent and below the button when the loop is inserted in position through the upholstered article.

8. A device according to claim 7, wherein said button is an ornamental button and comprises a closed eyelet, the smallest dimension of the bar being less than the diameter of the eyelet, whereby said bar can be inserted through said eyelet to secure said loop thereto in a half hitch knot.

* * * * *